US008181889B2

(12) United States Patent
Shahak

(10) Patent No.: US 8,181,889 B2
(45) Date of Patent: May 22, 2012

(54) POP-UP SPRINKLER

(75) Inventor: Haim Shahak, Kibbutz Gvat (IL)

(73) Assignee: Accurate Watering Ltd., Haifa (IL)

( * ) Notice: Subject to any disclaimer, the term of this patent is extended or adjusted under 35 U.S.C. 154(b) by 544 days.

(21) Appl. No.: 12/224,172

(22) PCT Filed: Apr. 12, 2007

(86) PCT No.: PCT/IL2007/000472
§ 371 (c)(1),
(2), (4) Date: Feb. 23, 2009

(87) PCT Pub. No.: WO2007/119235
PCT Pub. Date: Oct. 25, 2007

(65) Prior Publication Data

US 2009/0152377 A1 Jun. 18, 2009

Related U.S. Application Data

(60) Provisional application No. 60/792,316, filed on Apr. 17, 2006.

(51) Int. Cl.
*B05B 15/10* (2006.01)

(52) U.S. Cl. ..... 239/204; 239/203; 239/205; 239/206; 239/207; 239/587.1; 239/587.5; 239/240; 239/247; 239/507

(58) Field of Classification Search ..... 239/203, 239/204, 207, 282, 587.1, 587.5, 200, 205, 239/206, 237, 240, 247, 507, 513
See application file for complete search history.

(56) References Cited

U.S. PATENT DOCUMENTS 1,821,579 A * 9/1931 Rader ..... 239/206
(Continued)

FOREIGN PATENT DOCUMENTS

DE 21 63 127 6/1973
(Continued)

OTHER PUBLICATIONS

International Search Report issued for PCT Application No. PCT/IL2007/000472 mailed on Jun. 9, 2008.

(Continued)

*Primary Examiner* — Len Tran
*Assistant Examiner* — Trevor E McGraw
(74) *Attorney, Agent, or Firm* — Pearl Cohen Zedek Latzer, LLP

(57) ABSTRACT

The invention relates to irrigation by means of sprinklers for agriculture, lawns, golf courses and other applications. More particularly, the invention provides a sprinkler arranged to distribute water evenly over a field area of almost any shape. Preferably the invention relates to a pop-up sprinkler thus, when not in use, i.e., when no water pressure is applied, the entire device is level or below ground surface. The invention comprises: a lower water inlet, an inner member, within an upper housing, suspended on a vertical axis within the lower water inlet. An inner member within the upper housing being free to revolve around a vertical axis and revolvably supporting; at least one nozzle assembly having at least one water inlet and an outlet jet and being supported on a horizontal axis. Means for variably tilting the nozzle assembly(ies) in a horizontal axis in accordance with the changing angular position of the nozzle around the central vertical axis when water pressure is introduced into the lower water inlet housing. And means for imparting a vertical axis rotary movement to the inner member part within the upper housing directly supporting the at least one nozzle assembly.

11 Claims, 10 Drawing Sheets

U.S. PATENT DOCUMENTS

| | | | | |
|---|---|---|---|---|
| 2,601,559 | A | 6/1952 | Riblet | |
| 3,035,778 | A | 6/1958 | Kimbro et at | |
| 3,940,066 | A | 2/1976 | Hunter | |
| 3,957,205 | A | 5/1976 | Costa | |
| 4,073,438 | A | 2/1978 | Meyer | |
| 4,220,283 | A | 9/1980 | Citron | |
| 4,350,300 | A | 9/1982 | Vikre | |
| 4,351,477 | A | 9/1982 | Choi | |
| 4,867,378 | A | 9/1989 | Kah, Jr. | |
| 5,028,005 | A | 7/1991 | Van Diest | |
| 5,526,982 | A | 6/1996 | McKenzie | |
| 5,871,156 | A | 2/1999 | Lawson | |
| 5,938,121 | A | 8/1999 | Feruson | |
| 6,457,656 | B1 | 10/2002 | Scott | |
| 6,478,237 | B2 | 11/2002 | Kerby | |
| 6,488,218 | B1 | 12/2002 | Townsend | |
| 6,491,235 | B1 | 12/2002 | Scott | |
| 6,530,531 | B2 | 3/2003 | Butler | |
| 6,629,648 | B1 * | 10/2003 | Jones | 239/203 |
| 6,651,904 | B2 | 11/2003 | Roman | |
| 6,799,732 | B2 * | 10/2004 | Sirkin | 239/205 |
| 6,808,127 | B2 | 10/2004 | McNulty | |
| 7,048,208 | B1 | 5/2006 | Pruitt | |
| 7,097,116 | B2 | 8/2006 | Fernandez | |
| 7,392,956 | B2 * | 7/2008 | McKenzie et al. | 239/11 |
| 2002/0074432 | A1 * | 6/2002 | Kah et al. | 239/443 |
| 2002/0179734 | A1 | 12/2002 | Clark | |
| 2003/0071140 | A1 | 4/2003 | Roman | |
| 2003/0089796 | A1 * | 5/2003 | Kah et al. | 239/225.1 |
| 2004/0046046 | A1 | 3/2004 | Smith | |
| 2004/0050958 | A1 | 3/2004 | McKenzie et al. | |
| 2004/0195358 | A1 * | 10/2004 | Santiago et al. | 239/200 |
| 2005/0023378 | A1 * | 2/2005 | Gregory et al. | 239/522 |
| 2005/0167526 | A1 * | 8/2005 | McKenzie et al. | 239/225.1 |
| 2006/0283976 | A1 | 12/2006 | Wlodarczyk | |
| 2007/0029404 | A1 * | 2/2007 | Markley et al. | 239/206 |
| 2007/0158473 | A9 * | 7/2007 | Gregory et al. | 239/522 |

FOREIGN PATENT DOCUMENTS

| | | |
|---|---|---|
| FR | 2 555 914 | 6/1985 |
| GB | 1 437 275 | 5/1976 |
| GB | 2150862 | 7/1985 |

OTHER PUBLICATIONS

Supplementary European Search Report mailed on Jan. 19, 2010.
Office Action from Australian Application No. 2007237829 mailed on Sep. 14, 2010.

* cited by examiner

POP-UP SPRINKLER

CROSS-REFERENCE TO RELATED APPLICATIONS

This application is a National Phase Application of PCT International Application No. PCT/IL2007/000472, International Filing Date Apr. 12, 2007, claiming the benefit of U.S. Provisional Application No. 60/792,316, filed Apr. 17, 2006.

FIELD OF INVENTION

The present invention relates to irrigation by means of sprinklers for agriculture, lawns, golf courses and other applications.

More particularly, the invention provides a sprinkler arranged to distribute water evenly over a field area of almost any shape. Preferably the invention relates to a pop-up sprinkler thus, when not in use, i.e., when no water pressure is applied, the entire device is level or below ground surface.

BACKGROUND OF THE INVENTION

Due to an increasing shortage of fresh water and the higher cost of available water, wasteful irrigation systems which were acceptable when water was "too cheap to meter" are being replaced by more complex but more water-saving systems. One of these is an array of fixed-position sprinklers, which irrigate more or less evenly a circular area or a sector of a circular area.

Sprinklers in general and pop-up sprinklers in particular were developed for applications where a fixed sprinkler is unacceptable due to it forming an obstruction during normal use of the area. Typically an underground pipe array distributes pressured water to a first group of sprinklers for a predetermined time, after which computer-controlled solenoid valves divert the water to a second group of sprinklers, and so on until all areas to be watered have received the quantity of water intended.

Due to the substantial commercial possibilities of this irrigation tool, much effort has been invested in the attempt to provide an improved unit. The large number of patents on this subject makes a full review of prior art impractical. The following US Patents reflect the situation at the time of writing:

U.S. Pat. Nos. 3,940,066, 3,957,205, 4,073,438, 4,220,283, 4,350,300, 4,351,477, 5,028,005, 5,871,156, 5,938,121, 6,478,237, 6,488,218, 6,457,656, 6,491,235, 6,530,531, 6,651,904, 6,808,127, 7,048,208, 7,097,116 and US Patent Application Nos. 2002/0179734, 2003/0071140, 2004/0046046 and 2006/0283976.

Many of the prior art sprinklers can irrigate only a circular area with the sprinkler being disposed in the center of the circle. To irrigate a rectangular or square area close spacing (often referred to as "head to head" overlapping) is needed. Some designs rely on diaphragms to seal joints between moving components. However these diaphragm seals have a short working life particularly when the water contains solid particles, requiring replacement of the diaphragm in an underground unit, which is a difficult and time-consuming task. Other designs suffer from quickly blocked nozzles using normal irrigation water and require fine filtering of the feed water with the inevitable loss of water pressure resulting. Other designs are too complex for economic manufacture. Yet further designs are susceptible to early clogging, jamming or breakage. Consequently no prior-art design has yet won wide acceptance.

It is therefore one of the objects of the present invention to obviate the disadvantages of prior art devices and to provide a sprinkler which can be adjusted to economically irrigate areas of almost any shape.

It is a further object of the present invention to achieve even distribution of water over the area being irrigated.

The present invention achieves the above objects by providing a sprinkler being adjustable for the even irrigation of a land area of regular or irregular shape, said sprinkler comprising:

a lower water inlet, an upper member within upper housing suspended on a vertical axis within said lower water inlet housing, being free to revolve around a vertical axis and revolvably supporting;

at least one nozzle assembly having at least one water inlet and an outlet jet and being supported on a horizontal axis at least indirectly by said upper member within the said upper housing;

means for variably tilting said nozzle assembly(ies) in a horizontal axis in accordance with the changing angular position of said nozzle around the central vertical axis when water pressure is introduced into said lower water inlet housing; and means for imparting a vertical axis rotary movement to the inner member part within said upper housing directly supporting said at least one nozzle assembly.

In a preferred embodiment of the present invention there is provided a pop-up sprinkler comprising:

a lower water inlet, an upper housing attached to or being an integral part of, the said lower water inlet, an upper member within the said upper housing is slidably suspended on a vertical axis in said guide means of said lower water inlet housing, said upper member within said upper housing being slidable between an upper, deployed position and a retracted lower zero-flow position, and at least a part of said upper member within said housing being free to revolve around a vertical axis when in said upper, operating position, and revolvably supporting;

at least one nozzle assembly having at least one water inlet and an outlet jet and being supported on a horizontal axis at least indirectly by said upper housing:

means for variably tilting said nozzle assembly(ies) in a horizontal axis in accordance, with the changing angular position of said nozzle around the central vertical axis when water pressure is introduced into said lower water inlet housing and when said upper member within said upper housing is in its upper deployed state; and means for imparting a vertical axis rotary movement to the upper member within said upper directly supporting said at least one nozzle assembly.

In a preferred embodiment of the present invention there is provided a pop-up sprinkler wherein said means for variably tilting said nozzle assembly(ies) on a horizontal axis in accordance with the angular position on a vertical axis of said upper member within the upper housing comprises:

at least one thin flat ring cam made of a flexible material, held stationary by a non-revolving component of said sprinkler;

screw means for adjusting the height of any section of said flat ring cam; and a cam follower unit arranged for contact around a face of said flat ring cam, linkage elements being provided to connect said cam follower unit to said nozzle assembly and thereby to impart a tilting movement thereto.

In another preferred embodiment of the present invention there is provided a pop-up sprinkler wherein said linkage elements is an L-shaped post holding at its lower end said cam follower provided with an upward-facing roller while said upper end carries slot elements to engage a pin projecting from said nozzle(s).

In a further preferred embodiment of the present invention there is provided a pop-up sprinkler wherein said nozzle(s) is/are mounted in a revolvable turret suspended in a non-revolving portion, at least one sleeve member, able to emerge out of said upper housing, said sleeve placed within the upper housing, said turret provided at its lower end, flexible legs so when, it emerge (pop-up) through the upper housing said flexible legs located beneath the lower end of the sleeve member, lifting the sleeve.

In a further preferred embodiment of the present invention there is provided a pop-up sprinkler wherein there is provided a substantially vertical divider in said upper member (turret) within the upper housing to form a wet section and a dry section, wherein said at least at least one water inlet of said nozzle is disposed in said wet section while said nozzle outlet jet is disposed in said dry section.

In yet a further preferred embodiment of the present invention there is provided a pop-up sprinkler wherein pressurized water is fed to at least one of said nozzles through a tube serving as a pivot for tilting said nozzle, said water being fed through a tube, said water exiting said tube through an exit aperture in fluid communication with said central bore, said nozzle being provided with a water inlet aperture inside the pivot bore in contact with said tube, the inter-alignment of the two apertures varying during pivoting of said nozzle to provide a higher flow-rate when said nozzle outlet jet is tilted at an upward angle and a lower flow-rate when said outlet jet is directed nearer the horizontal plane.

In another preferred embodiment of the present invention there is provided pop-up sprinkler wherein said at least one thin flat ring cam is held in a plurality of radially spaced-apart track holders, said track holders being guided to allow free movement in a vertical plane, said track holders being provided with a vertical-plane screw thread to mate with an adjusting screw accessible for adjustment from a shoulder of said upper housing.

In most of the preferred embodiments of the present invention there is prodded a pop-up sprinkler wherein two nozzle assemblies are provided, a primary nozzle being configured for irrigating areas in the vicinity of the border of the area to be irrigated and a secondary nozzle assembly being arranged for irrigating areas nearer the sprinkler and to assist preserving an even precipitation rate upon the area confined inside the desired contour, and may have, in addition, at least one fixed unadjustable nozzle.

In order to reduce manufacturing expenses and using existing manufacturing lines and since it is realized that users of prior-art sprinklers may be reluctant to uproot the whole unit and replace it by a sprinkler according to the invention. To overcome this problem, the invention also provides for an upper part of the sprinkler which is adaptable to existing ready installed systems.

Yet further embodiments of the invention will be described hereinafter.

It will thus be realized that the novel device of the present invention serves to provide even coverage by automatically reducing the water flow accordingly when a section of the contour of the irrigated area is closer to the sprinkler. As an example, assuming that the speed of rotation on the vertical axis of the device is constant, it will be understood that for any fixed angle, e.g., 30° a sector between 8-10 meters distant from the sprinkler will be much larger than a sector between 4-6 meters away. Thus for even coverage the flow rate from the nozzle needs to be higher when a longer range area is being irrigated and lower for areas nearer the sprinkler. Also, many of the areas requiring irrigation are of a rectangular shape and not round, to serve this requirement the nozzle needs to be tilted further upwards in order to increase the sprinkler range in order to reach the corners of the area, and returned to its former position when the nozzle points in the direction of a side (particularly the longer side) of the rectangle. In the present invention this change of flow rate is achieved automatically in a simple manner, as will be seen in FIG. 6. It should be noted that, in addition, at least one fixed, unadjustable nozzle, in flow connection with the wet chamber, may be added for coverage of areas nearer the sprinkler.

The invention will now be described further with reference to a pop-up sprinkler and to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized. It should be noted that the same arrangement could be used for regular non pop-up sprinklers.

DETAILED DESCRIPTION OF PREFERRED EXEMPLARY EMBODIMENTS

Figure 1:
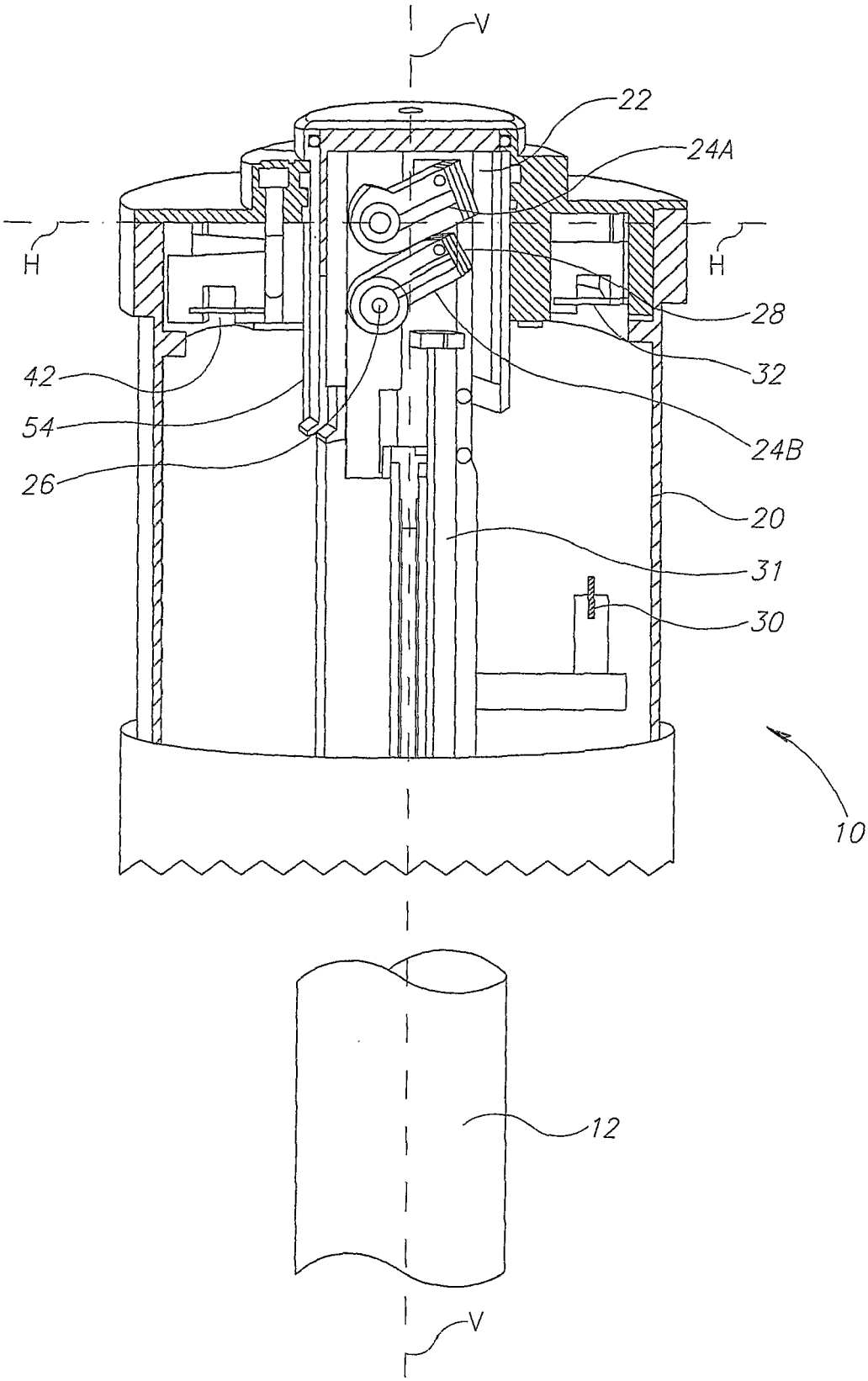
FIG. 1 is a partially-sectioned perspective view of a preferred embodiment of the sprinkler according to the invention, seen in its retracted state.
Figure 2:
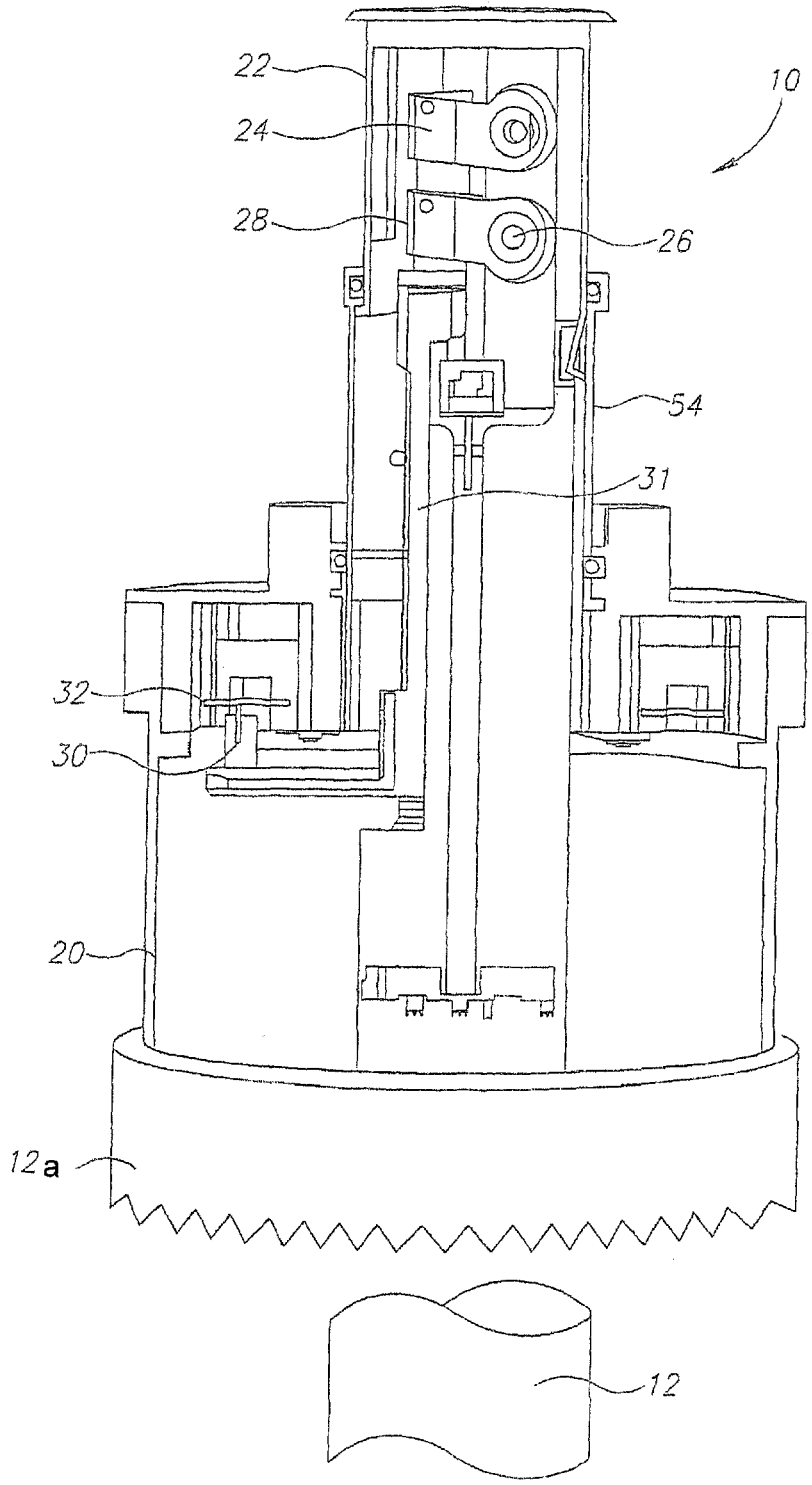
FIG. 2 is as FIG. 1 but in a deployed state.

There is seen in FIGS. 1 and 2 a pop-up sprinkler 10 being adjustable for the even irrigation of a land area of regular or irregular shape. Primary features will be described here, while more detailed description of parts will be provided with reference to the following figures.

A lower water inlet 12 forms the base of the sprinkler 10. Said inlet 12 has a conventional water inlet connection as well known in the art.

The housing 20 and upper member 22 is slidable, within housing (sleeve) 54, between an upper, deployed position (FIG. 2) and a retracted lower zero-flow position (FIG. 1). The upper member, to be referred to as a turret 22, is suspended on a vertical axis VV of the upper housing 20. The turret 22 is free to revolve around the vertical axis VV when in the upper, operating position.

Two nozzle assemblies 24 are seen in this preferred embodiment. Each nozzle assembly 24 has a water inlet 26 and an outlet jet 28. Each nozzle 24 is supported on a horizontal axis HH in the revolvable turret 22.

The tilting angle of the nozzle assemblies 24 in a horizontal axis typically changes several times during the course of one revolution of the turret 22, in accordance with an adjustment by the user, as required, for precise irrigation of the area located within the contour.

Nozzle tilting originates from a cam follower 30, mechanically linked to the nozzles, making contact with a cam disk 32. The follower 30 is displaced vertically while traveling around the face of the cam disk 32, so that nozzle tilting occurs in accordance with the changing angular position of the follower 30 and turret 22. The vertical movement of the cam follower 30 is transferred and converted on a vertical axis VV to a rotary movement of the nozzles by a mechanism 31. An example of a preferred mechanism will be described with reference to FIG. 4. The cam follower 30 contacts the cam disk 32 only when water pressure is introduced into the lower water inlet housing 12, thereby moving turret 22 within the upper housing 20 to its upper deployed state.

Means is provided for imparting a vertical axis VV rotary movement to the turret 22. Description of a preferred embodiment will be given with reference to FIG. 10.

In the illustrated preferred embodiment the nozzle assembly, referred to here as 24*a* is a primary nozzle configured for irrigating areas in the vicinity of the outer border of the area to be irrigated, and is typically disposed at an angle of about 30° above the horizontal. The secondary nozzle assembly, referred to here as 24*b*, has narrower flow passages and lower flow rates, for irrigating areas nearer the sprinkler.

With reference to the rest of the figures, similar reference numerals have been used to identify similar parts.

Figure 3A:
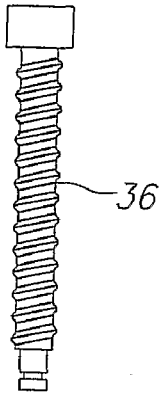
FIG. 3 is a perspective view showing one of the track holders, the flexible cam disk and an adjusting screw.
Figure 3B:
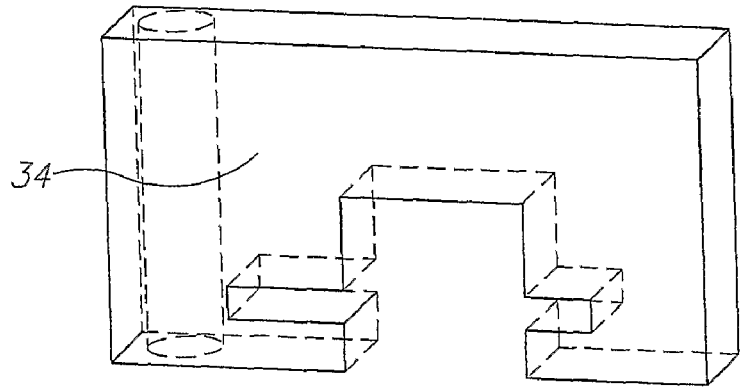
Figure 3C:
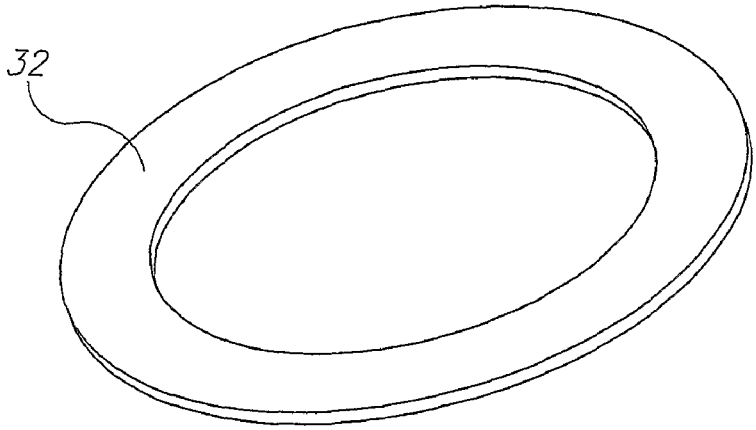

FIG. 3 presents a detail of a preferred embodiment of the pop-up sprinkler.

Figure 8:
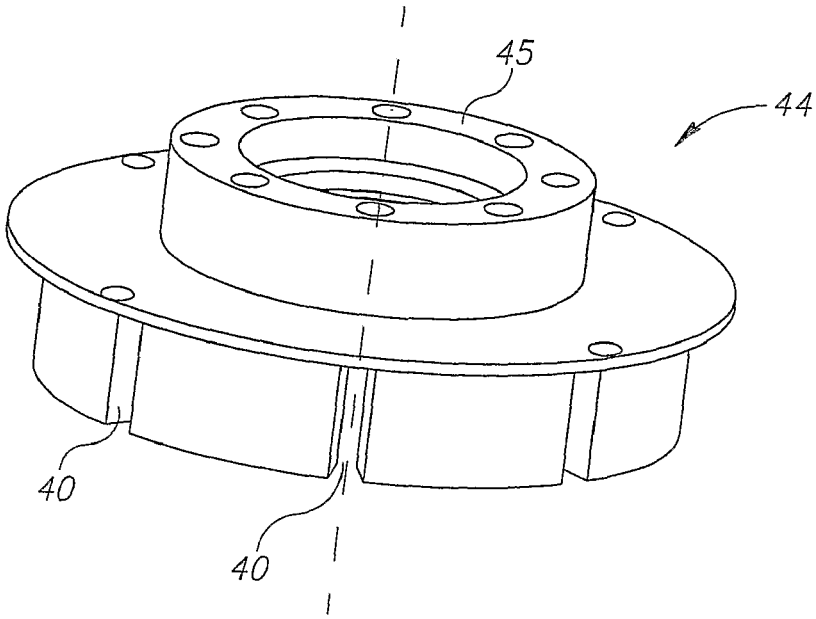
FIG. 8 is a perspective view of a non-rotating flange serving dual purposes.

The flexible cam disk 32 comprises a thin flat ring made of a flexible material, suitably stainless steel is retained in eight (more or less) radially-spaced track holders 34, only one of which is shown. The vertical position of the track holders 34 can be individually changed by use of eight adjustment screws 36, one of which is seen in the diagram, the heads 38 of which are accessible from the top of the shoulders of upper housing 20. The track holders 34 are restrained from turning by being restricted to eight slots 40, as seen in FIG. 8. Each track holder 34 has a partially open lower edge 42 (visible in FIG. 1) which is useful for insertion therein of the disk 32 and is also used to allow passage of the cam follower 30, when in contact with the cam disk 32, as seen in FIG. 4.

Figure 4:
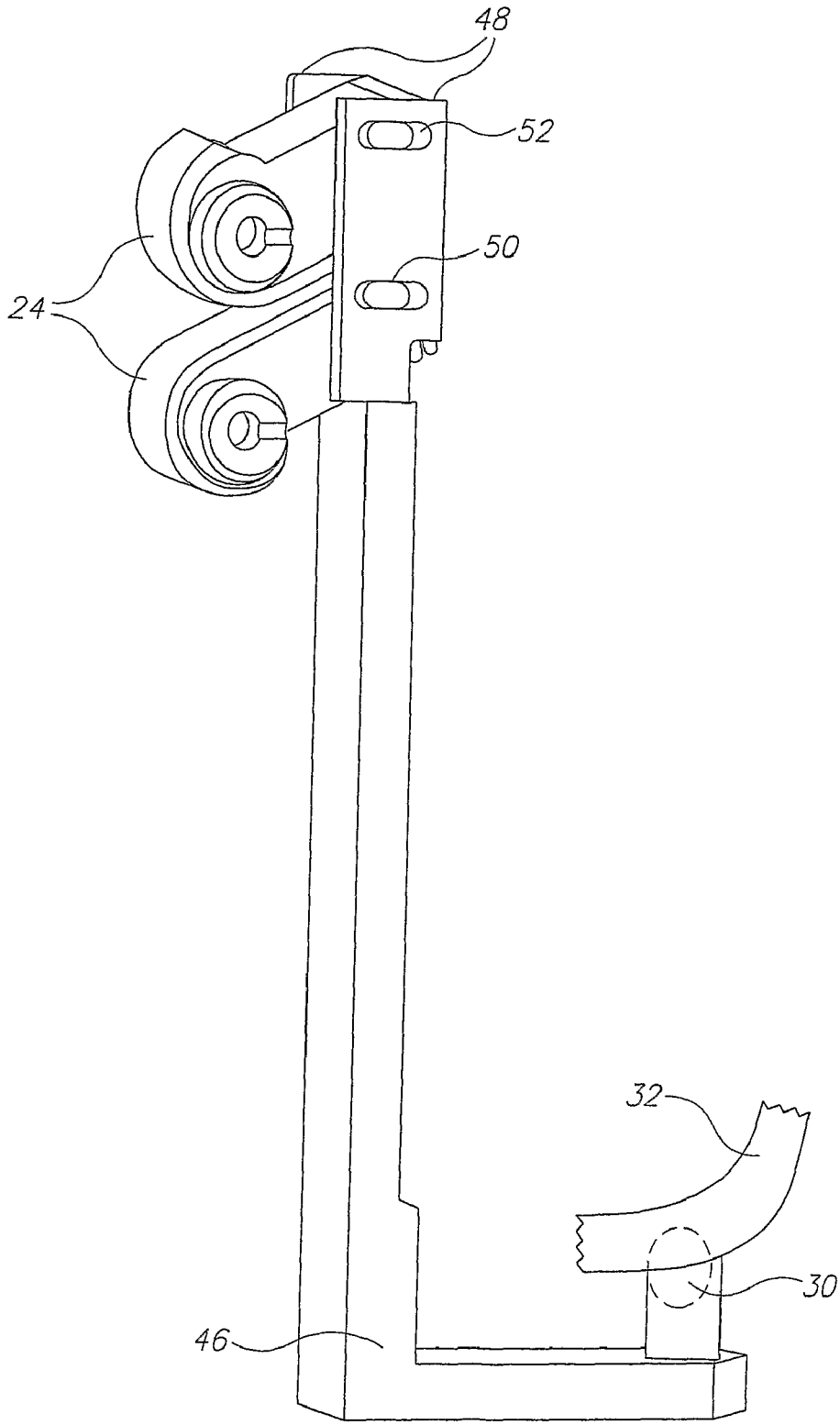
FIG. 4 is a perspective view of a nozzle tilt mechanism.

A preferred method for nozzle tilting is seen in FIG. 4. The profile of the flexible cam disk 32 can be adjusted by use of the eight adjustment screws 36 either before use or while in use, as seen in FIG. 3. The cam is held rotationally stationary by the non-revolving flange 44. The cover of upper housing 20 which carries the slots 40 restraining the track holders 34, as seen in FIG. 8.

As seen in FIG. 2 after water pressure is applied to the sprinkler 10, the turret 22 rises (pop-up), the cam follower 30 comes into contact with the cam disk 32 and nozzle tilting will occur according to the profile of the cam disk 32.

FIG. 4 shows a linkage mechanism shown comprising an L-shaped post 46 holding at its lower end the cam follower 30. The cam follower 30, as shown, has an upward-facing roller at its upper extremity. In a further embodiment (not shown) the cam follower is tipped with a low-friction wear-resistant material such as acetal, nylon, polyurethane or Teflon and no roller is required.

The upper end of the L-shaped post 46 is forked 48 and carries slots 50 to engage a pin 52 projecting from each nozzle. Vertical movement of the post 46 causes the desired nozzle tilting which enables the sprinkler during each rotation to both reach further out and to irrigate areas nearer the sprinkler as required.

The same nozzle tilting action can be obtained by using other suitable mechanisms, (not shown) for example mounting the nozzles in a foamed, or very soft, rubber or foamed plastic, located as a sealing, near the vertical divider (60, FIG. 6) between the wet and the dry sections, arranging to adopt the horizontal and vertical movements of the nozzle, while the nozzles pivots up and down, by the throttling cylindrical body or mounting the nozzles on an eccentric shaft (52*a*, FIG. 7) which is seated near the said vertical divider, between the wet and the dry sections. The nozzles are mechanically connected to the cam follower, using shaft 52 connections.

Figure 5:
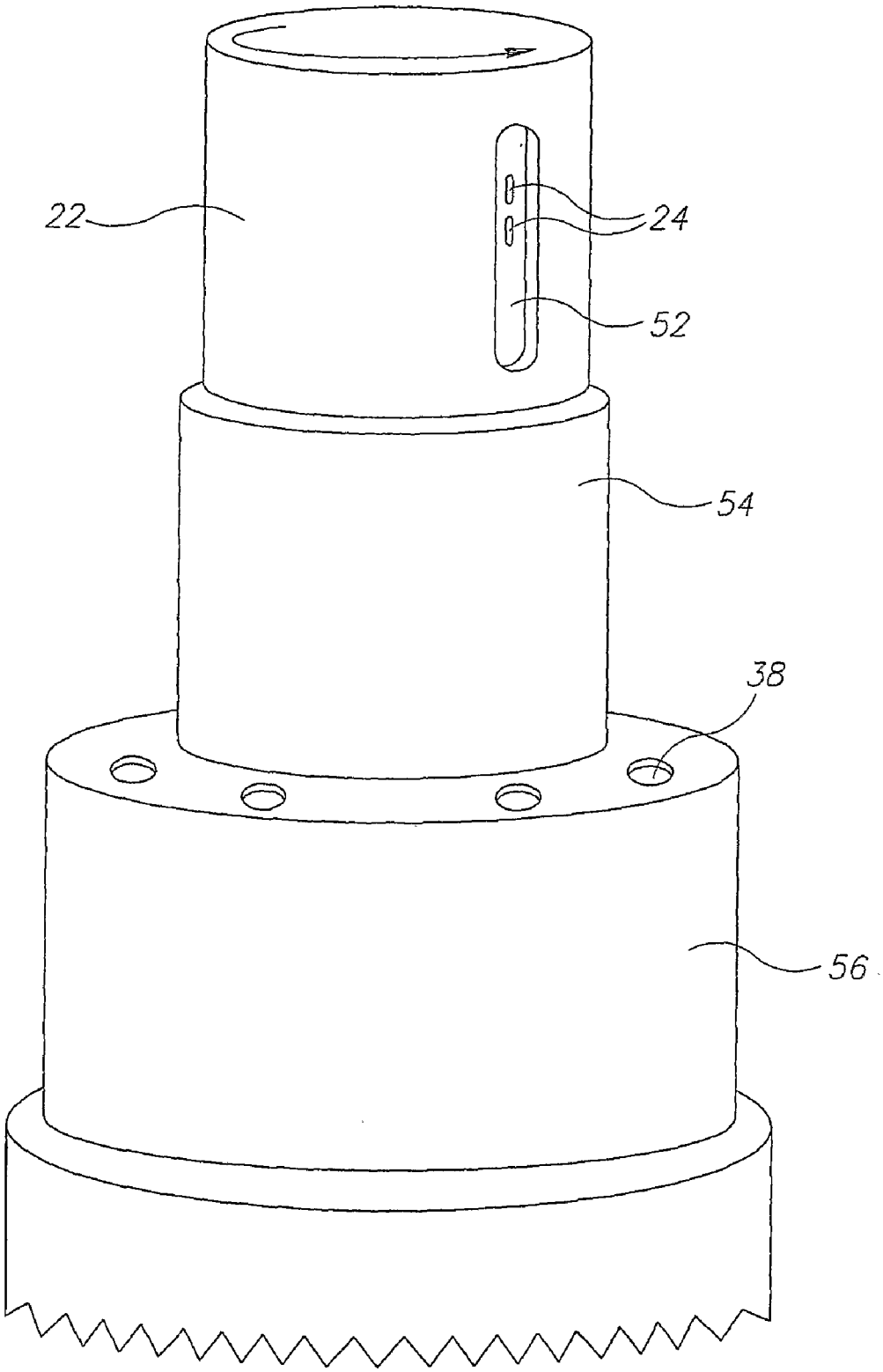
FIG. 5 is a perspective view of a telescopic embodiment.

Seen in FIG. 5 is an outline of a preferred telescoping upper housing for the pop-up sprinkler. The nozzles 24 are mounted in the revolvable turret 22, the turret being suspended in a non-revolving sleeve 54 of the upper housing. The nozzles outlet jets emerge through the slot 52.

The upper housing is comprised of two sections 54 and 56, in addition to the turret 22 which includes an outer top cover. The two sections 54, 56 can be opened and closed in a vertical plane in a telescopic manner.

Sleeve 54 permits the nozzle assembly to impart only when sleeve 54 is above the ground level, and vice versa.

Accordingly, the above up and down movement of the nozzles alleviates the nozzles from touching the ground surface dirt and debris.

Figure 6:
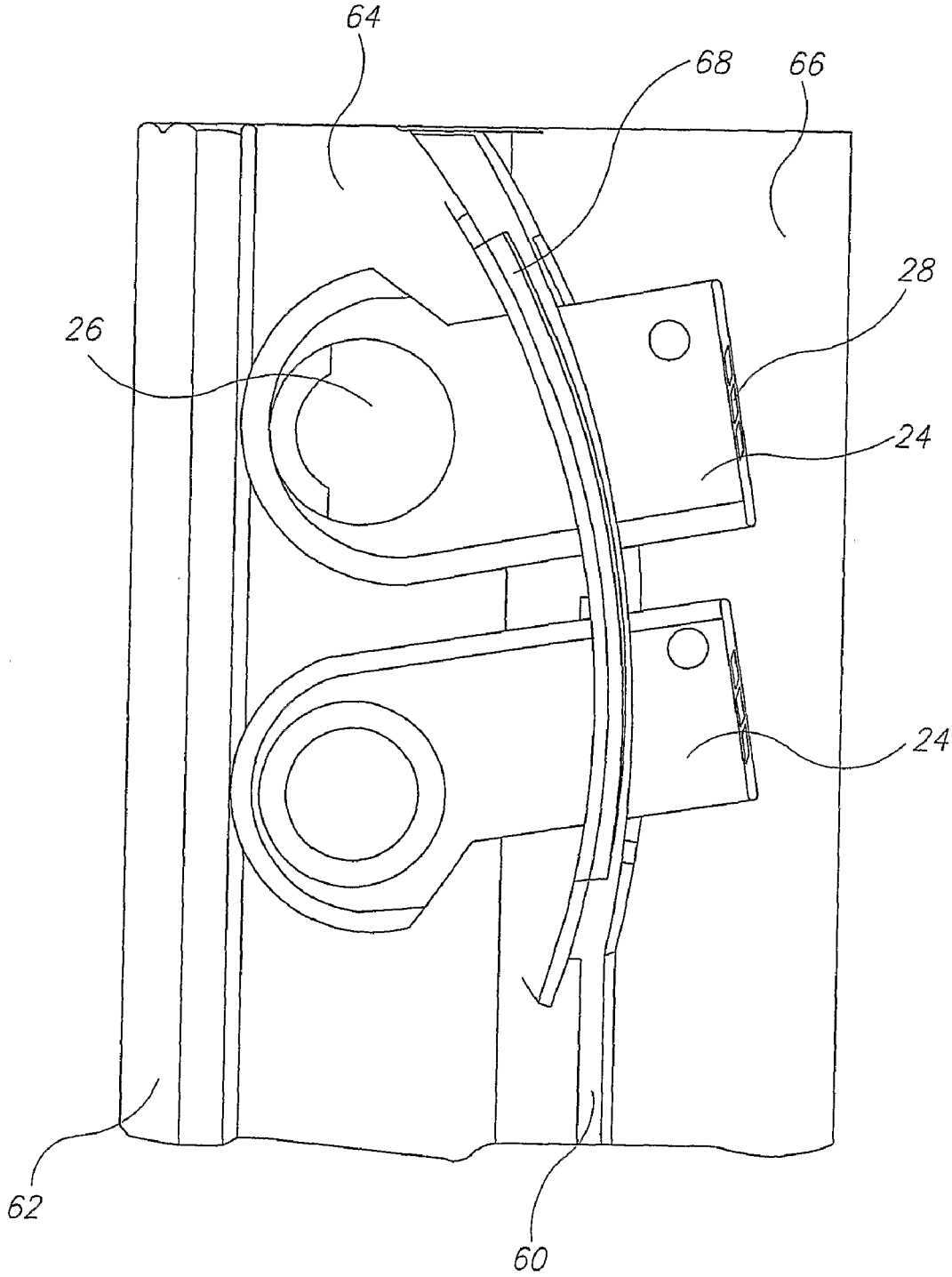
FIG. 6 is a detail elevational view of nozzles extending from a wet chamber into a dry area.

Referring now to FIG. 6, there is depicted a detail of a pop-up sprinkler wherein there is provided a substantially vertical divider 60 in the turret to form a wet section 64 and a dry section 66. The nozzles 24 project outwardly from the wet section 64 into the dry section 66, so that the water inlet 26 of the nozzle 24 is disposed in the wet section 64 while the nozzle outlet jet 28 is disposed in the dry section 66. Flexible seal elements 68 attached to the divider 60 prevent water entering the dry section. A ring seal could also be used for each of the nozzles, as described below in FIG. 7.

Figure 7:
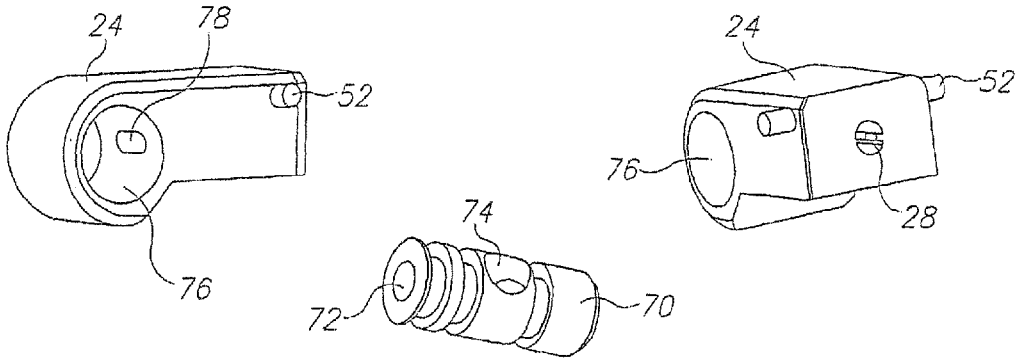
FIGS. 7, 7*a*, 7*b* and 7*c* are perspective views of the nozzles embodiments.

FIG. 7 shows several preferred embodiments of the nozzle assembly with flow pressure control.

Figure 7A:
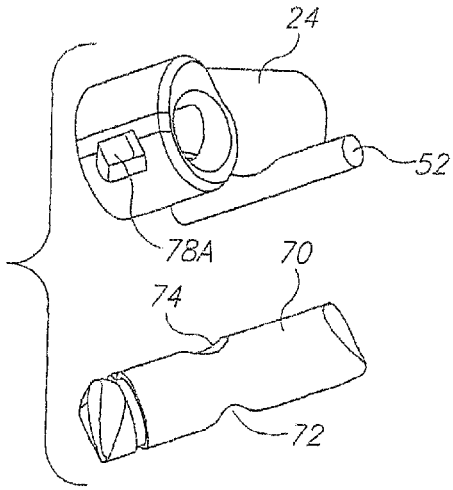

Pressurized water is received by a horizontal axis tube 70, the tube also serving as a pivot for tilting of the nozzle 24. Water enters the central bore 72 of the tube 70, and exits the tube through an aperture 74 connecting the central bore 72 to the outer diameter of the horizontal tube 70. The outer diameter of the tube is in revolving contact with the nozzle bore 76, which is provided with a water inlet aperture 78 in a wall of the nozzle pivot bore 76. The rate of water flow is thus dependent on the degree of inter-alignment of the two apertures 74, 78. The degree of inter-alignment changes as the nozzle 24 is tilted on its pivot. The nozzle is arranged to provide a higher flow-rate when the nozzle outlet jet 28 is tilted at an upward angle (for irrigating distant areas) and a lower flow-rate when the outlet jet is directed nearer the horizontal plane for the irrigation of areas nearer the sprinkler. It should be noted that tube 70 could be a cylindrical body having a different inlet and outlet as seen in the various embodiments, where the water passage passing across the cylindrical bodies and the throttling process is done through a rear inlet (78*a*) at tube 76, rather then at inlet 78, as seen in FIG. 7*a* and FIG. 7*b*.

Figure 7B:
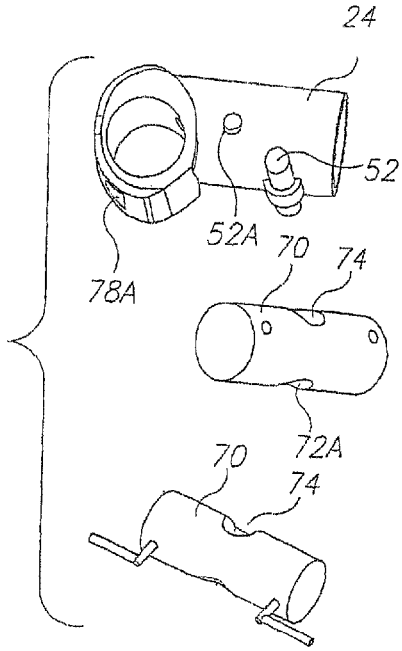

In FIG. 7*b* the nozzle is pivoted through shaft 52*a* while the cylindrical body adopts the position, inside bore 76 by mean of two "L" shape axes, one end of the said axes is pivoted through seats in the inner wall of the turret while the cylindrical body is free to slide forward and backward, along the other end.

Figure 7C:
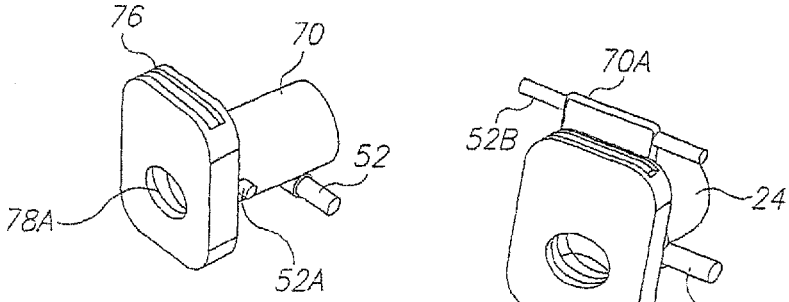

Another embodiment is seen in FIG. 7*c*, where the throttling is done through a throttling plate 70*a*. The throttling plate 70*a* is free to rotate about shaft 52*b*. Shaft 52*b* moves horizontally forward and backward through a seat in the interior wall of the turret at a stable fixed vertical height.

While the nozzle in FIG. 7*c* changes tilting position, about shaft 52*a*, plate 70*a* enters or exits from or into the slot in the rear section of the nozzle and changes the effective size of the nozzles inlet so that a throttling action is performed.

FIG. 8 illustrates flange 44 (the cover of upper housing 20) which supports the sleeve 54 and the revolvable turret 22 seen in FIG. 1. The slots 40 are a sliding fit to the track holders 34, which before the insertion of the adjusting screws 36 are free to move vertically, as seen in FIG. 3.

The upper face 45 of the flange 44 provides ready access to all the adjusting screws 36, as seen in FIG. 3.

Figure 9:
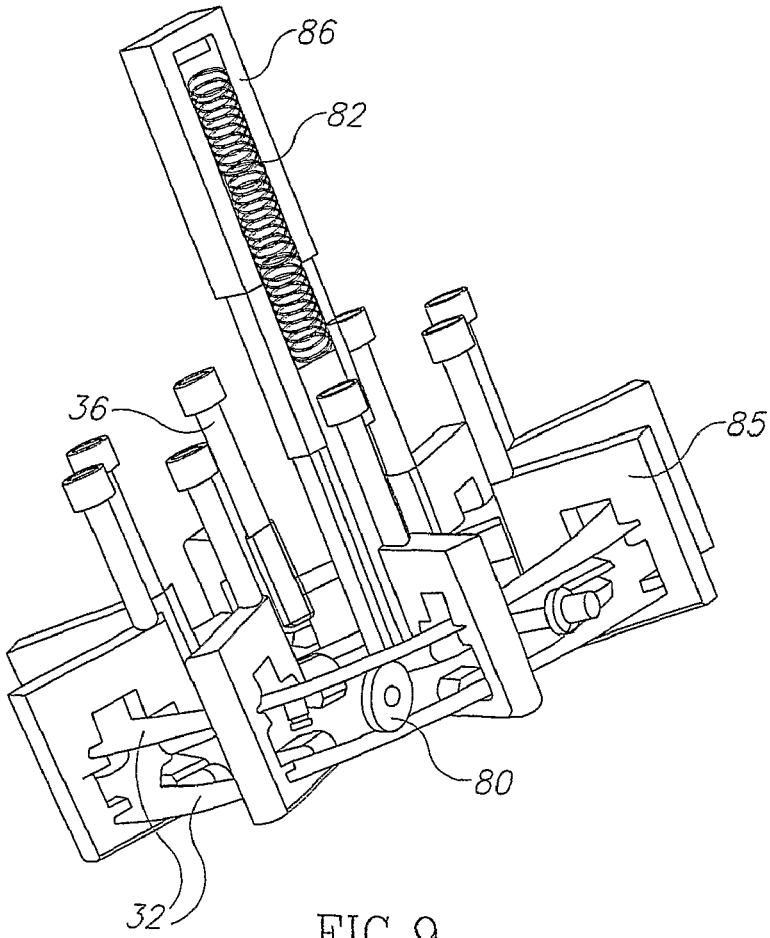
FIG. 9 is a partially-sectioned perspective view of an embodiment having two parallel spaced-apart cam disks.

Seen in FIG. 9 are details of the mounted mechanism within said non revolving flange 44. The mechanism comprises two vertically spaced-apart flat ring cam disks 32, the disks being supported in parallel planes by eight radially spaced-apart track holders 85. Depending on the size of the sprinkler, more or less track holders could be used.

The cam follower 80 is provided with a horizontal axis wheel. The wheel 80 is slightly smaller than the height differential between the two ring cam disks 32.

The advantage of the double cam surface embodiment is that the follower 80 is positively driven both up and down and will thus overcome minor movement restrictions ("sticking") often caused by an accumulation of dirt inside the sprinkler.

A tension spring 82 is used to ensure the downward stretching of the telescopic linkage element 86, at pop-up operational position after the convergence while cessation of water pressure inside the sprinkler.

Said mechanism is one possible utilization of a convergence linkage element between the follower and the nozzle, which enables to significantly shorten the upper housing 20.

Figure 10:
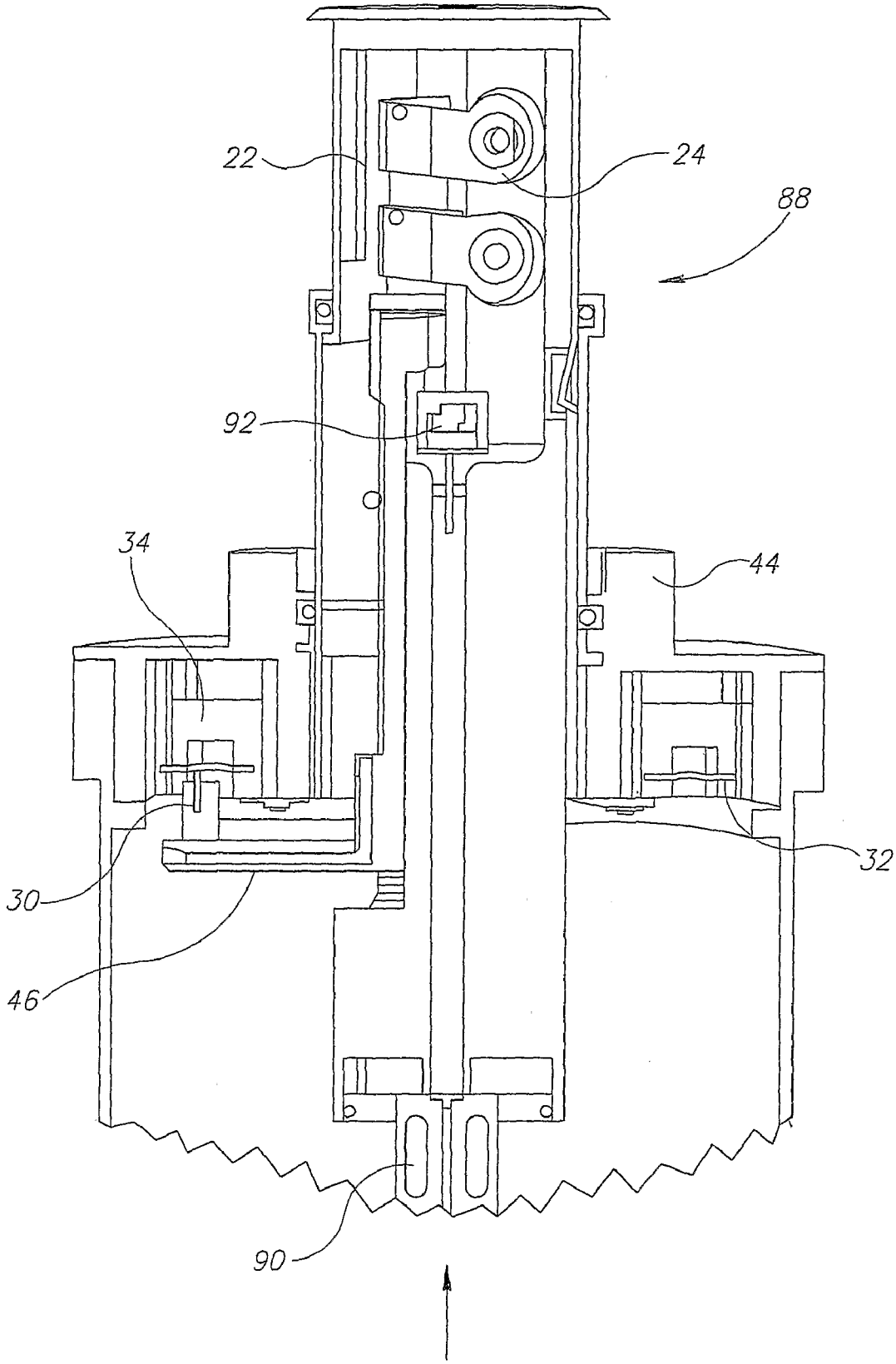
FIG. 10 is a partially sectioned elevational view of the rotational drive.

Referring now to FIG. 10, there is depicted a detail of a pop-up sprinkler 88 wherein at least a part of the ingoing pressurized water drives a turbine 90. The turbine is connected to a speed reducing assembly. The speed reducer then drives the turret 22 which houses the nozzle assemblies 24, around a vertical axis when the turret 22 is in its upper, operating position.

Figure 11:
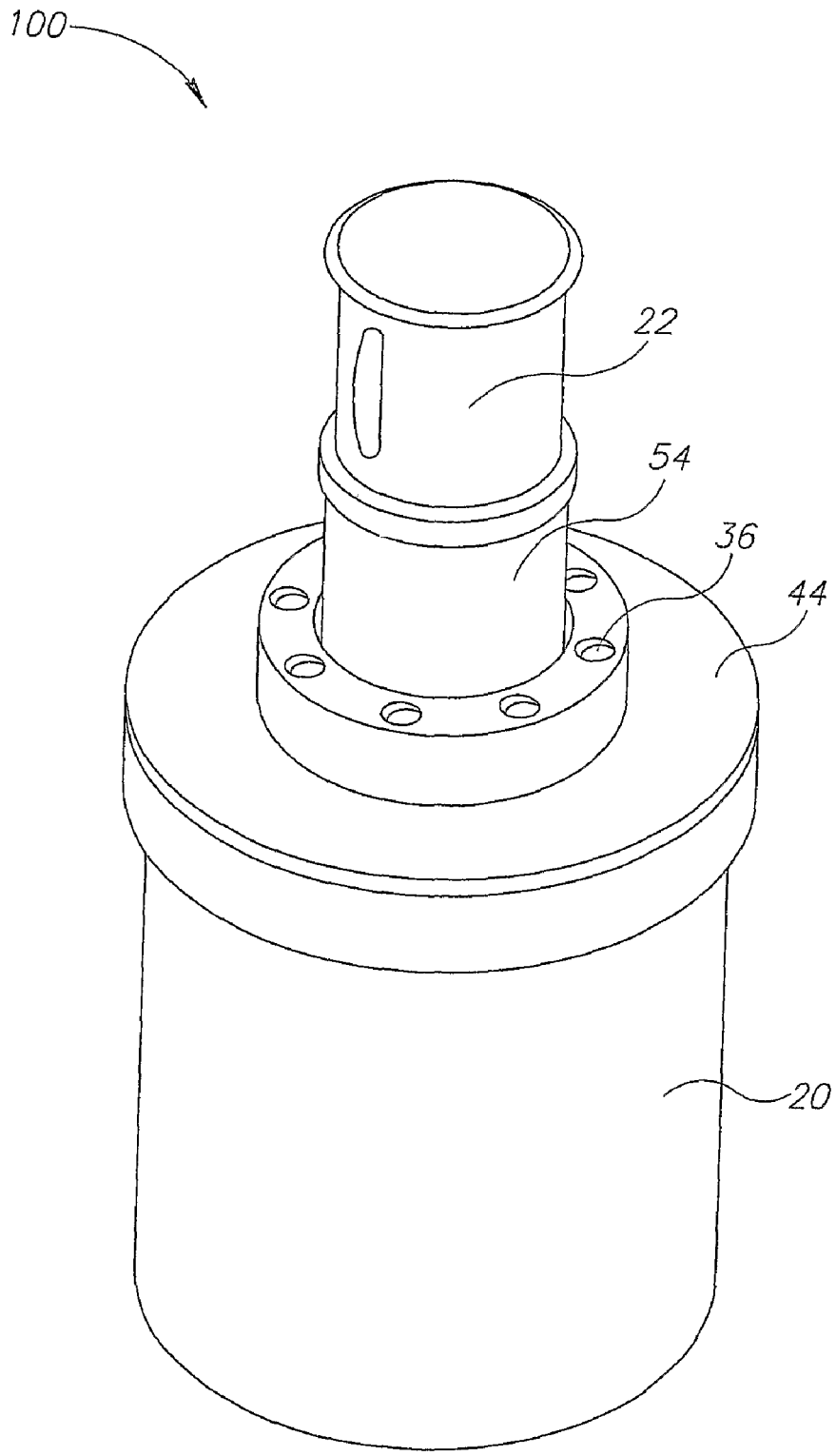
FIG. 11 is a perspective view of the upper part of the sprinkler arranged to be assembled to a prior-art lower portion.

Seen in FIG. 11 is a perspective view of the appearance of the device 100 for a pop-up sprinkler 10 as described with reference to FIG. 1. The upper housing 20 is configured to compatibly fit the prior-art sprinklers lower housing as far as possible. In most systems only some minor modifications are needed to allow replacement of the upper housing while leaving the lower housing in place. These modifications can be carried out in the manufacturing facility of the present sprinkler, the nature of the modification being dependant on the geometry of the lower housing 12*a* seen in FIG. 2. Assembly of the prior-art lower housing can then be effected in the field. The invention can be integrated as an integral part of modifying regular pop-up sprinklers, as well.

The scope of the described invention is intended to include all embodiments coming within the meaning of the following claims. The foregoing examples illustrate useful forms of the invention, but are not to be considered as limiting its scope, as those skilled in the art will readily be aware that additional variants and modifications of the invention can be formulated without departing from the meaning of the following claims.

I claim:

1. A pop-up sprinkler being adjustable for the even irrigation of a land area of regular or irregular shape, said sprinkler comprising:

a lower water inlet, a lower water inlet housing;

an upper member within upper housing suspended on a vertical axis within said lower water inlet housing, being free to revolve around a vertical axis and revolvably supporting;

at least one nozzle assembly having at least one water inlet and an outlet jet and being supported on a horizontal axis at least indirectly by said upper member within the said upper housing;

means for variably tilting said at least one nozzle assembly in a horizontal axis in accordance with the changing angular position of said nozzle around the central vertical axis when water pressure is introduced into said lower water inlet housing; and means for imparting a vertical axis rotary movement to directly supporting said at least one nozzle assembly; and wherein said means for variably tilting said at least one nozzle assembly further comprises:

at least one thin flat ring cam made of a flexible material, held stationary by a non-revolving component of said sprinkler;

screw means for adjusting the height of any section of said flat ring cam; and a cam follower unit arranged for contact around a face of said flat ring cam, linkage elements being provided to connect said cam follower unit to said nozzle assembly and thereby to impart a tilting movement thereto.

2. A sprinkler as claimed in claim 1, said sprinkler comprising:

an upper housing attached to, or being an integral part of the said lower water inlet, an upper member within the said upper housing is slidably suspended on a vertical axis in a guide means of said lower water inlet housing, said upper member within said upper housing being slidable between an upper, deployed position and a retracted lower zero-flow position, and at least a part of said upper member within said housing being free to revolve around a vertical axis when in said upper, operating position, and revolvably supporting;

at least one nozzle assembly having at least one water inlet and an outlet jet and being supported on a horizontal axis at least indirectly by said upper housing;

means for variably tilting said at least one nozzle assembly in a horizontal axis in accordance, with the changing angular position of said nozzle around the central vertical axis when water pressure is introduced into said lower water inlet housing and when said upper member within said upper housing is in its upper deployed state; and means for imparting a vertical axis rotary movement to the upper member within said upper housing directly supporting said at least one nozzle assembly.

3. The pop-up sprinkler as claimed in claim 1, wherein said linkage elements is an L-shaped post holding at its lower end said cam follower provided with a facing roller while said upper end carries slot elements to engage a pin projecting from said at least one nozzle.

4. The pop-up sprinkler as claimed in claim 1, wherein said at least one nozzle is/are mounted in a revolvable turret suspended in said upper housing.

5. The pop-up sprinkler as claimed in claim 1, wherein there is provided a substantially vertical divider in said upper housing to form a wet section and a dry section, wherein said at least one water inlet of said nozzle is disposed in said wet section while said nozzle outlet jet is disposed in said dry section.

6. The pop-up sprinkler as claimed in claim 1, wherein pressurized water is fed to at least one of said nozzles through a cylindrical body or tube that may serve as a pivot for tilting said nozzle, said water being fed to the said cylindrical body or tube, said water exiting said tube through an exit aperture in fluid communication, said nozzle being provided with a water inlet aperture inside the pivot bore in contact with said tube, the inter-alignment of the two apertures varying during pivoting of said nozzle to provide a higher flow-rate when said nozzle outlet jet is tilted at an upward angle and a lower flow-rate when said outlet jet is directed nearer the horizontal plane.

7. The pop-up sprinkler as claimed in claim 1, wherein said at least one thin flat ring cam is held in a plurality of radially spaced-apart track holders, said track holders being guided to allow free movement in a vertical plane, said track holders being provided with a vertical-plane screw thread meant to mate with an adjusting screw accessible for adjustment from a shoulder of said upper housing.

8. The pop-up sprinkler as claimed in claim 1, wherein two vertically spaced apart flat ring cams are provided, and are supported by a plurality of radially spaced-apart track holders.

9. The pop-up sprinkler as claimed in claim 1, wherein at least a part of said ingoing pressurized water drives a turbine connected by a speed reducing element to revolve the part of said upper housing which is free to revolve around a vertical axis when in said upper, operating position.

10. The pop-up sprinkler as claimed in claim 1, wherein two nozzle assemblies are provided, a primary nozzle being configured for irrigating areas in the vicinity of the border of the area to be irrigated and a secondary nozzle assembly being arranged for irrigating areas nearer the sprinkler, and may have, in addition, at least one fixed unadjustable nozzle.

11. The pop-up sprinkler as claimed in claim 1, wherein said upper housing comprises a plurality of sections which can be erected and closed in a vertical plane in a telescopic manner.

* * * * *